US006869307B2

(12) United States Patent
Endo

(10) Patent No.: US 6,869,307 B2
(45) Date of Patent: Mar. 22, 2005

(54) CONNECTOR FOR FLAT CABLE

(75) Inventor: Toshio Endo, Tokyo (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 10/464,538

(22) Filed: Jun. 19, 2003

(65) Prior Publication Data

US 2003/0236026 A1 Dec. 25, 2003

(30) Foreign Application Priority Data

Jun. 20, 2002 (JP) ..... 2002-180509

(51) Int. Cl.[7] ..... H01R 12/24
(52) U.S. Cl. ..... 439/492
(58) Field of Search ..... 439/492–495, 439/497, 499, 77, 67

(56) References Cited

U.S. PATENT DOCUMENTS 4,630,874 A * 12/1986 Renn et al. ..... 439/263
5,580,257 A 12/1996 Harwath
6,210,174 B1 * 4/2001 Pei et al. ..... 439/67

FOREIGN PATENT DOCUMENTS

JP 07-057825 3/1995
JP 08-306446 11/1996

OTHER PUBLICATIONS

Official Notice by the Japanese Patent Office in Japanese Patent Appl. No. 2002–180509, dated Aug. 20, 2004.

* cited by examiner

*Primary Examiner*—Javaid H. Nasri
(74) *Attorney, Agent, or Firm*—Finnegan, Henderson, Farabow, Garrett & Dunner, LLP

(57) ABSTRACT

A positioning section for positioning a terminal section of the flexible printed circuit is provided at a position adjacent to a movable ground terminal and a movable signal terminal of a fixed ground terminal and a fixed signal terminal in a cable accommodation portion.

11 Claims, 17 Drawing Sheets

CONNECTOR FOR FLAT CABLE

This application claims priority from Japanese Patent Application No. 2002-180509 filed Jun. 20, 2002, which is incorporated hereinto by reference.

BACKGROUND OF THE INVENTION

1. Field of the Invention

The present invention relates to a connector for a flat cable for the electric connection between the flat cable and a wiring board.

2. Description of the Related Art

A cable connector has been practically used for the electric connection between electric parts in an electronic equipment. For example, the electric parts are electrically connected to a printed wiring circuit board via a flat cable (FFC) or a flexible printed circuit(FPC). The cable connector being in practical use includes a rotary type and a sliding type, for example, which are different from each other in the method for fixing the cable.

As shown in FIGS. 16A and 16B, the sliding type cable connector includes a connector body 18 disposed on a printed wiring board 2 and having a cable accommodation portion 16, a plurality of contact terminals 20*ai* (wherein i=1 to n; n is a positive integer) provided in the cable accommodation portion 16 of the connector body 18, for electrically connecting an electrode section of the printed wiring board 2 with a terminal section 6E of a flexible printed circuit 6, and a stopper member 22 supported to be slidable relative to the connector body 18.

The connector body 18 is provided at one end thereof with an inserting opening 24 for allowing the terminal section 6E of the flexible printed circuit 6 to be connected to pass through the same. The inserting opening 24 is communicated with the cable accommodation portion 16 formed in the interior of the connector body 18. The cable accommodation portion 16 in the connector body 18 is defined by the inner wall of the connector body 18 encircling the same. A guide groove 18*g* is provided in the inner wall of a portion of the cable accommodation portion 16 forming the upper region thereof, for supporting opposite ends of the stopper member 22 to be slidable along the same, and extends in the direction for the attachment/detachment of the flexible printed circuit 6. The stopper member 22 is operated when a movable terminal portion of the contact terminal 20*ai* is attached to or detached from the terminal section 6E of the flexible printed circuit 6 and the stopper member 22 has a pressing-surface 22*a* in a region opposed to the movable terminal portion of the contact terminal 20*ai*. The pressing surface 22*a* presses a back plate 6B of the flexible printed circuit 6 toward the movable terminal portion of the contact terminal 20*ai* described later, while sliding along the back plate 6B.

A guide surface 22*b* having a slant 22*s* is formed in a middle portion of a surface of the stopper member 22 opposite to the pressing surface 22*a*.

The plurality of contact terminals 20*ai* are arranged in the cable accommodation portion 16 in correspondence with the arrangement of the terminal section 6E of the flexible printed circuit 6. The respective contact terminal 20*ai* is comprised of a fixed terminal portion 20S soldered to the terminal section of the printed wiring board 2, a guide piece 20B, a movable terminal portion 20A bifurcated therefrom, and a coupling section 20C for connecting the fixed terminal portion 20S to a joint at the confluence of the guide piece 20B and the movable terminal portion 20A.

A tip end of the guide piece 20B of the respective contact terminal 20*ai* is positioned to face to the guide surface 22*b* of the stopper member 22. The movable terminal portion 20A has a contact portion at a tip end thereof to be electrically connected to the terminal section 6E of the flexible printed circuit 6.

The coupling section 20C is fixed to the connector body 18 by press-fitting a projection thereof into a slit formed adjacent to the cable accommodation portion 16 of the connector body 18.

Thus, when the slant 22*s* of the stopper member 22 is away from the cable accommodation portion 16 and the guide piece 20B; that is, in an unlocked state as shown in FIG. 16A, the slant 22*s* of the guide piece 20B is away from the guide piece 20B to result in a non-engaged state relative to the guide piece 20B. Accordingly, it is possible to insert the terminal section 6E of the flexible printed circuit 6 into the cable accommodation portion 16 through the inserting opening 24.

In this structure, during the electric connection of the terminal section 6E of the flexible printed circuit 6 with the contact portion of the respective contact terminal 20*ai*, after the terminal section 6E of the flexible printed circuit 6 has been inserted to a position in the vicinity of a rear wall 18*a* defining a rear side of the cable accommodation portion 16 in the direction shown by an arrow F through the inserting opening 24 when the slant 22*s* of the stopper member 22 is away from the cable accommodation portion 16, a tip end of the stopper member 22 is made to slide in the direction shown by an arrow L. Thus, the terminal section 6E of the flexible printed circuit 6 is pressed onto the contact portion of the movable terminal portion 20A of the contact terminal 20*ai* by the pressing surface 22*a* of the stopper member 22 to result in the electric connection.

At that time, the terminal section 6E of the flexible printed circuit 6 is nipped between the pressing surface 22*a* of the stopper member 22 and the elastically deformed movable terminal portion 20A of respective contact terminal 20*ai* and maintained there by the mutual frictional force.

In the above-mentioned cable connector, when a signal in a relatively high frequency band is transmitted, the impedance matching between the electronic equipment and the connector is proposed as a countermeasure for restricting a cross-talk or a reflection of signal that is considered to be a cause of the distortion of waveform.

Also, it has been known that the signal transmission performance in a relatively high frequency band is enhanced in the cable connector by reducing the inductance by shortening a length L between the contact portion and the proximal end of the movable terminal portion 20A of the contact terminal 20*ai* shown in FIG. 16A, together with the impedance matching.

When the length L is shortened between the contact portion and the proximal end of the movable terminal portion 20A of the contact terminal 20*ai* as described above to reduce the inductance, it is necessary to change a spring constant of the movable terminal portion 20A.

For example, when the movable terminal portions 20A different in spring constant each other are elastically deformed, the relationship between a displacement δ in the contact portion and a load P applied to the contact portion is represented by straight lines La and Lb as shown in FIG. 17. In FIG. 17, the vertical axis and the horizontal axis represent the load P and the displacement δ, respectively, so that the change in load P that acts on the contact portion is illustrated in correspondence to the displacement δ of the contact portion.

When the spring constant of the movable terminal portions 20A different each other, the straight lines La and Lb illustrate that the gradient of the straight line La describing the spring constant is smaller than the that of straight line Lb. Accordingly, in an allowable the load P range from Pa to Pb (for example, from 30 g to 50 g), as the range should not be changed even if the length L is shortened to increase the spring constant, thus, an allowable the displacement δ range of the contact portion is changed from a range from δ3 to δ4 (δA); for example, from 0.2 to 0.3 mm; in accordance with the straight line La to a smaller and narrower range from δ1 to δ2 (δB) in accordance with the straight line Lb.

However, when the stopper member 22 is injection-molded and the contact terminal 20*ai* is manufactured by the press, as suppressing the variance of the manufacturing accuracy of the parts has a fixed limit, it may be difficult to coincide the above-mentioned displacement width of the contact portion with the allowable range (δB) from δ1 to δ2 in accordance with the straight line Lb.

SUMMARY OF THE INVENTION

By taking the above problems into consideration, an object of the present invention is to provide a connector for a flat cable for electrically connecting a flat cable to a printed wiring board by a predetermined contact pressure in a movable terminal portion of a connector terminal, capable of shortening a length of the movable terminal portion without being influenced by the variance of the manufacturing accuracy of the constituent parts and thus capable of enhancing the signal transmission performance in a relatively high frequency band.

In accordance with the present invention which attains the above object, there is provided A connector for a flat cable comprising: a first contact terminal including a movable terminal-forming section disposed adjacent to an accommodation portion for accommodating a coupling section of a flat cable, having a movable contact portion for the electric connection with an electrode section of the coupling section, and a bias portion for biasing the electrode section of the flat cable toward the movable contact portion of the movable terminal-forming section at a predetermined pressure; a second contact terminal including a movable terminal-forming section disposed together with the first contact terminal adjacent to the accommodation portion, the movable terminal-forming section having a movable contact portion for the electric connection with the electrode section of the coupling section in the flat cable and; a positioning section formed in the accommodation portion for locating the electrode section of the coupling section relative to the movable contact portion in the first and second contact terminals at a predetermined position in the displacement direction of the movable contact portion.

As can be seen from the above description, with connector for a flat cable according to the present invention, since a positioning section formed in the accommodation portion locates the electrode section of the coupling section relative to the movable contact portion in the first and second contact terminals at a predetermined position in the displacement direction of the movable contact portion, under a predetermined contact pressure in a movable terminal portion of a connector terminal, the connector is capable of shortening a length of the movable terminal portion without being influenced by the variance of the manufacturing accuracy of the constituent parts and thus is capable of enhancing the signal transmission performance in a relatively high frequency band.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 3:
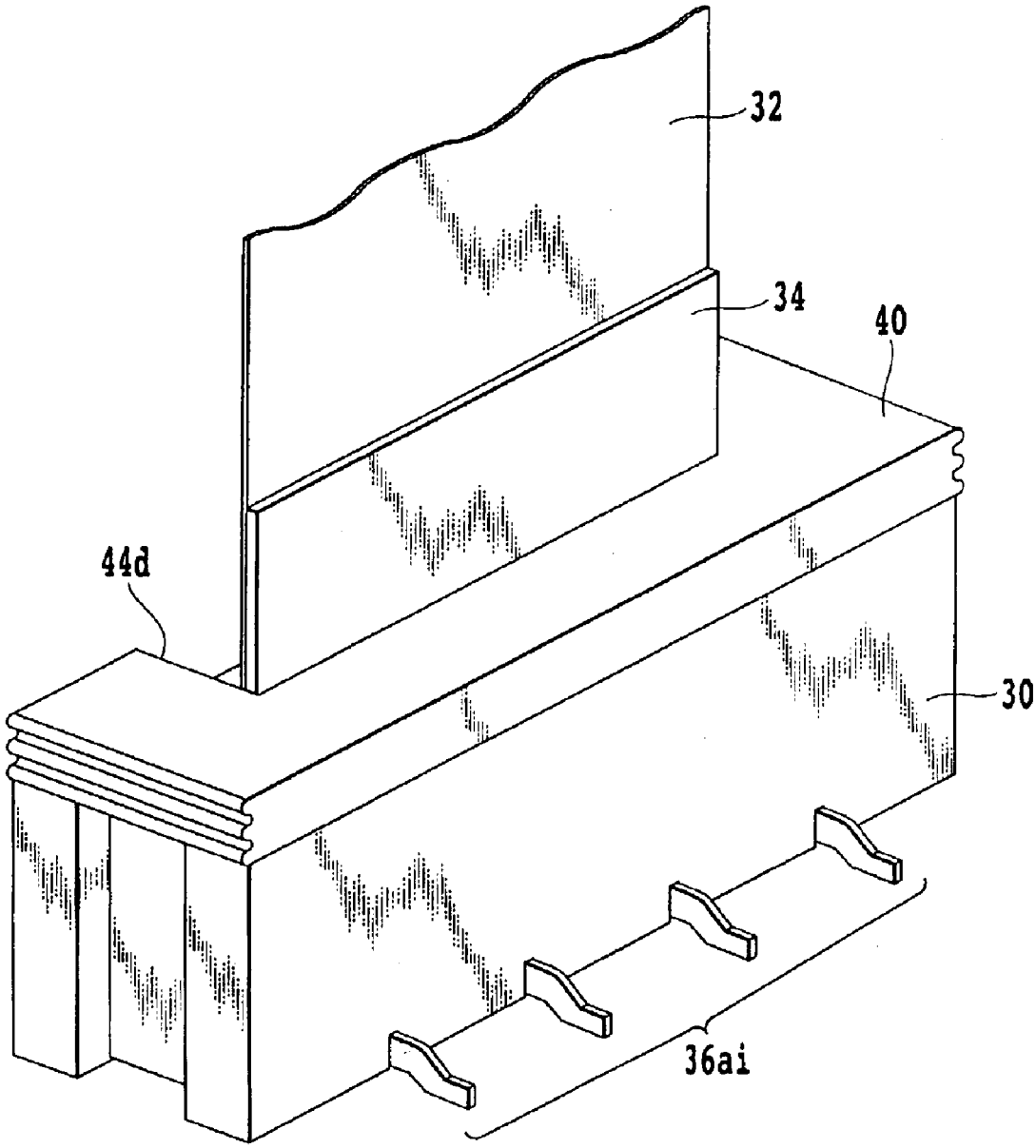
FIG. 3 is a perspective view illustrating the appearance of the flat cable connector according to the first embodiment of the present invention.
Figure 4:
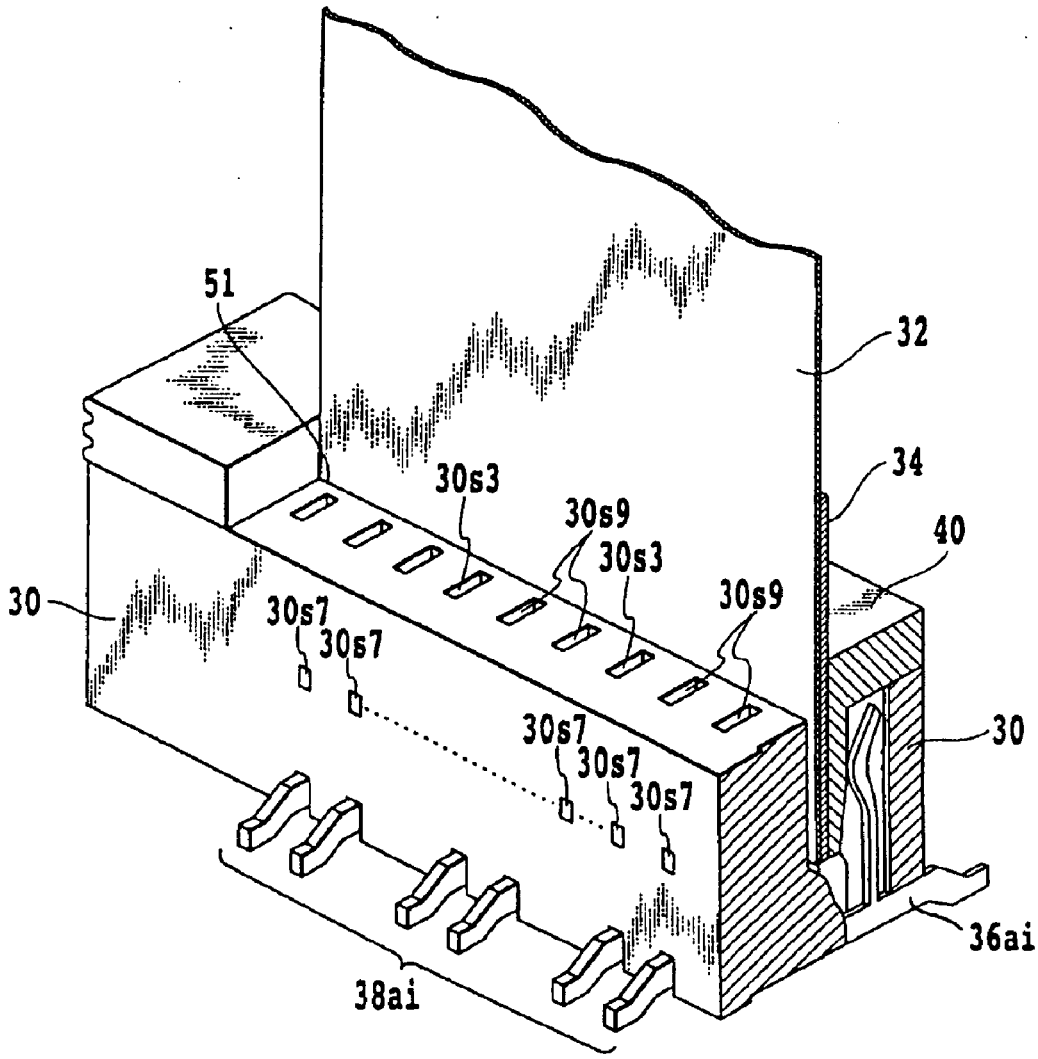
FIG. 4 is a partially cutway perspective view illustrating the appearance of the inventive flat cable connector according to the first embodiment.

FIGS. 3 and 4 illustrate an appearance of a flat cable connector according to a first embodiment of the present invention, respectively.

The cable connector includes a connector body 30 disposed, for example, on a printed wiring board 42 described later and having a cable accommodation portion 48, a plurality of fixed ground terminals 36*ai* (wherein i=1 to n; n is a positive integer) and a plurality of movable ground terminals 46 provided in the cable accommodation portion 48 of the connector body 30, for electrically connecting an electrode section of the printed wiring board 42 to a ground line in a terminal section 32E of a flexible printed circuit 32, a plurality of fixed signal terminals 38*ai* (wherein i=1 to n; n is a positive integer) and a plurality of movable signal terminals 44 provided adjacent to the cable accommodation portion 48 of the connector body 30, for electrically connecting the electrode section of the printed wiring board 42 to a signal line in the terminal section 32E of the flexible printed circuit 32, and a stopper member 40 supported to be slidable relative to the connector body 30.

The flexible printed circuit 32 is called, for example, as YFLEX (a registered trade mark) in which a plurality of conductive layers covered with a protective layer are formed on an insulative substrate. The insulative substrate is molded out of liquid crystal polyester (LCP), glass-epoxy resin, polyimide (PI), polyethylene terephthalate (PET) or polyether imide (PEI) to have a thickness of approximately 50 μm. The conductive layer is formed, for example, of copper alloy. The protective layer is, for example, a thermoset type resist layer or a polyimide film.

On one surface of a connected side end of the flexible printed circuit 32 to be, a back plate 34 is provided. The back plate 34 is formed, for example, of polybutylene terephthalate (PBT) to have a predetermined thickness.

Figure 1:
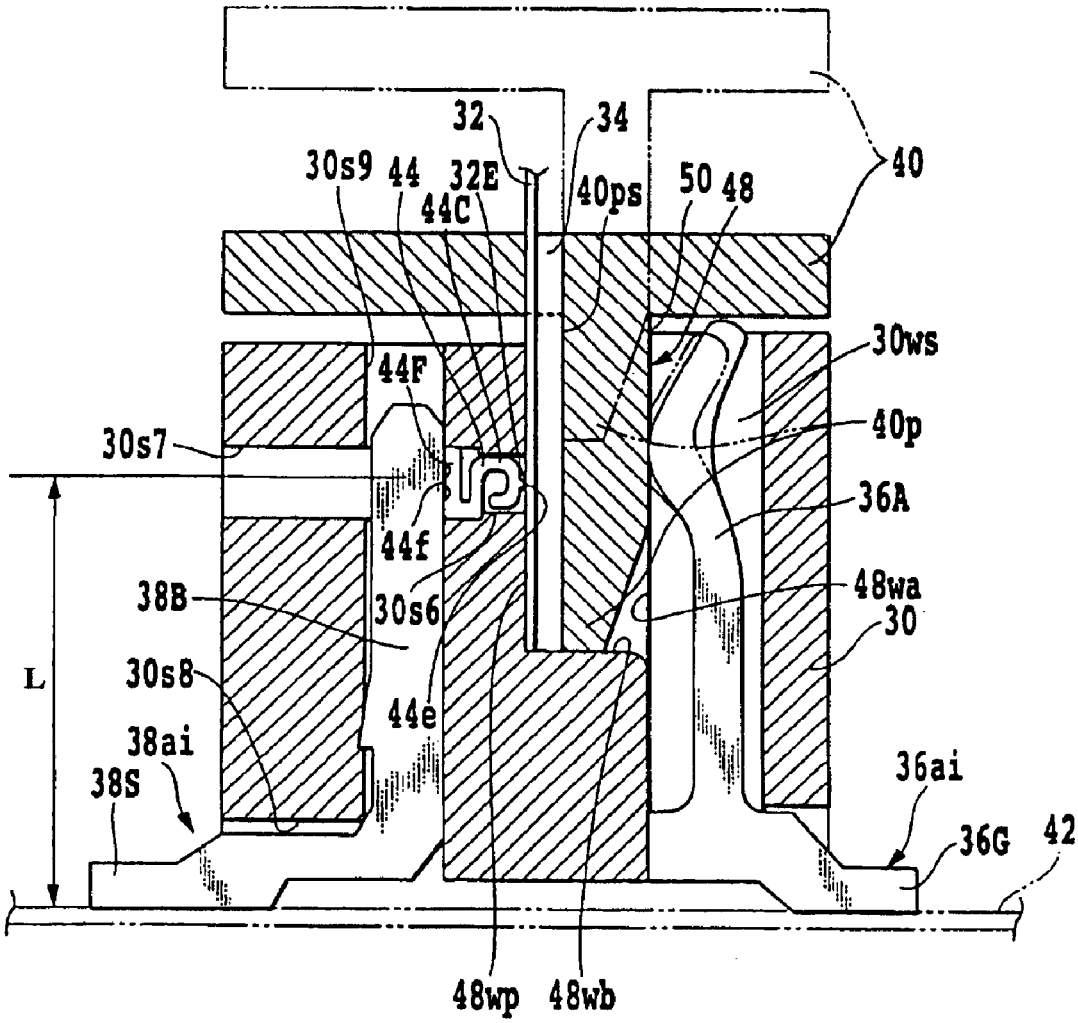
FIG. 1 is a partially sectional view of a substantial part of a flat cable connector according to a first embodiment of the present invention.
Figure 2:
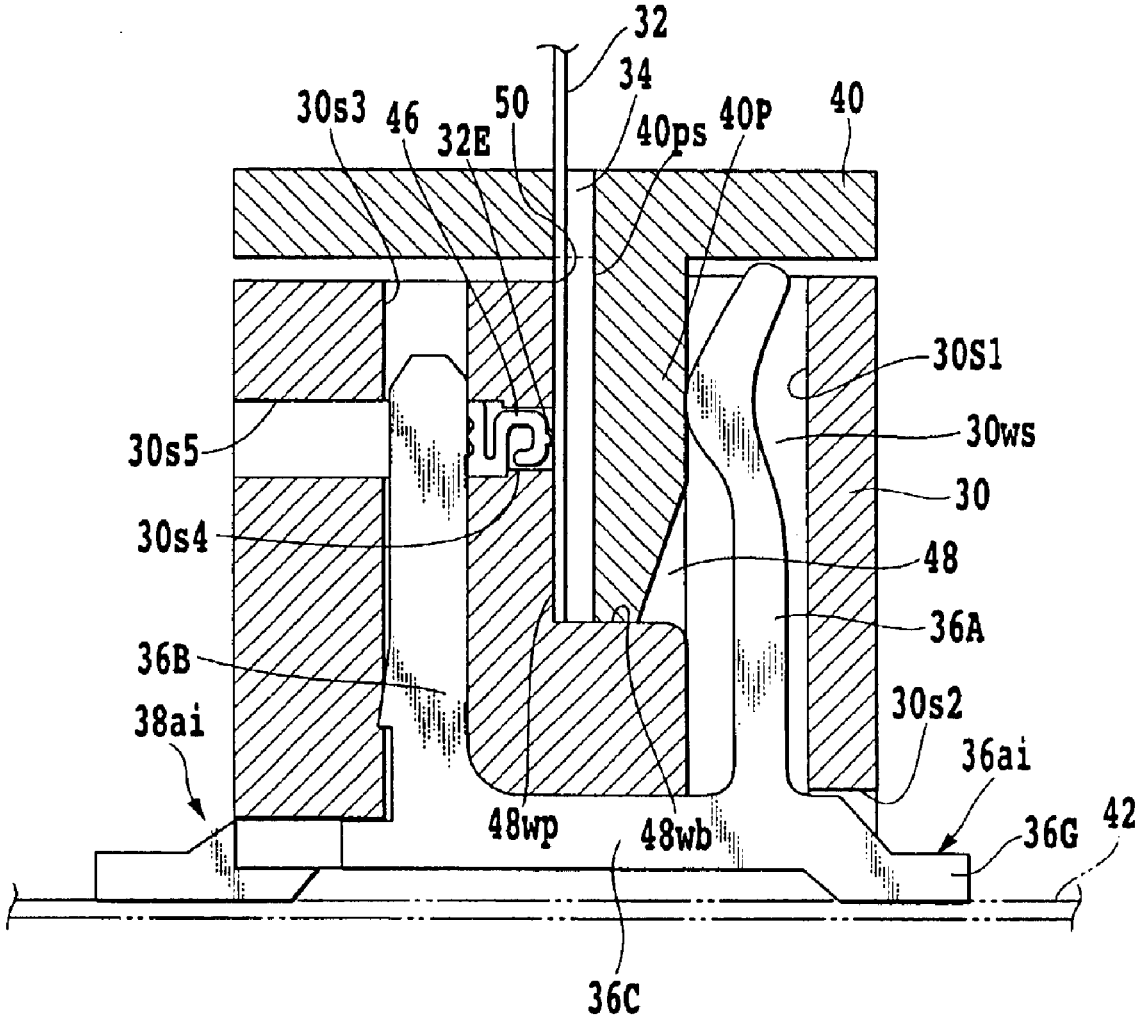
FIG. 2 is a partially sectional view of the substantial part of the flat cable connector according to the first embodiment of the present invention.

On the other surface of the end of the flexible printed circuit 32, as shown in FIGS. 1 and 2, the terminal section 32E is formed, having a plurality of electrodes of a predetermined width, for example. The terminal section 32E consisting of a group of signal electrodes and a group of ground electrodes are electrically connected to a conductive layer within the flexible printed circuit 32. Two ground electrodes connected to the ground line are formed to away from each other at a predetermined mutual distance while intervening in two signal electrodes to be connected to the signal line.

A stopper member 40 for selectively holding the flexible printed circuit 32 on the connector body 30 includes a flat portion having a notch 44d encircling the flexible printed circuit 32 and placed on the end surface of the periphery of an inserting opening 51 in the connector body 30, and a pressing piece 40*p* projected from a surface opposed to the connector body 30 in the flat portion.

A pressing surface 40*ps* of the pressing piece 40*p* in the stopper member 40 operated when the terminal section 32E of the flexible printed circuit 32 is attached to or detached from the movable signal terminal 44 and the movable ground terminal 46 is inserted into the cable accommodation portion 48 while sliding along the back plate 34 of the flexible printed circuit 32, as shown by a chain double-dashed line in FIG. 1. The pressing piece 40*p* has a slant at a tip end thereof, and the pressing surface 40*ps* of the pressing piece 40*p* presses the back plate 34 onto a positioning portion 48*wp* described later and toward the movable signal terminal 44 and the movable ground terminal 46.

The connector body 30 has the inserting opening 51 at one end thereof for allowing the terminal section 32E of the flexible printed circuit 32 to be connected and the back plate 34 to pass through the same. The inserting opening 51 is communicated with the cable accommodation portion 48 formed in the interior of the connector body 30. The cable accommodation portion 48 in the connector body 30 is defined by the inner wall of the connector body 30 encircling the same. The inner wall consists of a portion 48*wa* formed in correspondence to the outer surface contiguous to the slant of the pressing piece 40*p* in the inserted stopper member 40, a portion 48*wb* touching to a tip end of the pressing piece 40*p* of the stopper member 40 when the terminal section 32E of the flexible printed circuit 32 is connected, the positioning portion 48*wp* for positioning the terminal section 32E, and opposite lateral surfaces extending generally vertical to the paper of FIG. 1.

On one side adjacent to the cable accommodation portion 48, a plurality of slits 30*s*1 are formed as shown in FIG. 2. In each of the slits 30*s*1, a pressing piece 36A of the fixed ground terminal 36*ai* is inserted as a first contact terminal, respectively. The respective slits 30*s*1 are communicated with the cable accommodation portion 48. The adjacent slits 30*s*1 are sectioned by a partition wall 30*ws*. On the other side adjacent to the cable accommodation portion 48, a slit 30*s*3 into which is press-fit the connection terminal section 36B of the respective fixed ground terminal 36*ai* is formed opposite to the slit 30*s*1 in a plane common thereto. The slits 30*s*1 and 30*s*3 are connected with each other via a slit 30*s*2 formed at an end of the connector body 30 to be fixed to the printed wiring board 42. As shown in FIG. 2, the slits 30*s*1 and 30*s*3 are formed generally parallel to each other and generally vertical to the surface being connected of the printed wiring board 42 while intervening the cable accommodation portion 48 between the both. Also, the slit 30*s*2 into which is inserted a coupling section 36C described later is formed in generally parallel with the surface being connected of the printed wiring board 42.

As shown in FIG. 2, the plurality of fixed ground terminals 36*ai* are made of metal sheet, for example, of phosphor bronze or beryllium copper, and arranged in the cable accommodation portion 48 in correspondence to the ground electrodes of the terminal section 32E of the flexible printed circuit 32. The respective fixed ground terminal 36*ai* includes a fixed terminal section 36G soldered to the terminal section of the printed wiring board 42, the connection terminal section 36B and the pressing piece 36A formed generally parallel to each other in a bifurcate manner, and the coupling section 36C for coupling the fixed terminal section 36G with the joint between the connection terminal section 36B and the pressing piece 36A.

A curved portion of the pressing piece 36A in the respective fixed ground terminal 36*ai* is disposed face to the pressing piece 40*p* of the inserted stopper member 40. When the pressing piece 40*p* of the stopper member 40 is not inserted, the curved portion of the pressing piece 36A enters the cable accommodation portion 48 as shown by a chain double-dashed line in FIG. 1. On the other hand, when the pressing piece 40*p* of the stopper member 40 is inserted, the curved portion of the pressing piece 36A is pushed away from the cable accommodation portion 48 by the pressing piece 40*p* as shown by a solid line in FIGS. 1 and 2. Thus, the pressing piece 36A presses, as biasing portion, the pressing piece 40*p* of the inserted stopper member 40 toward the positioning portion 48*wp* in the cable accommodation portion 48 at a predetermined pressure.

Figure 6:
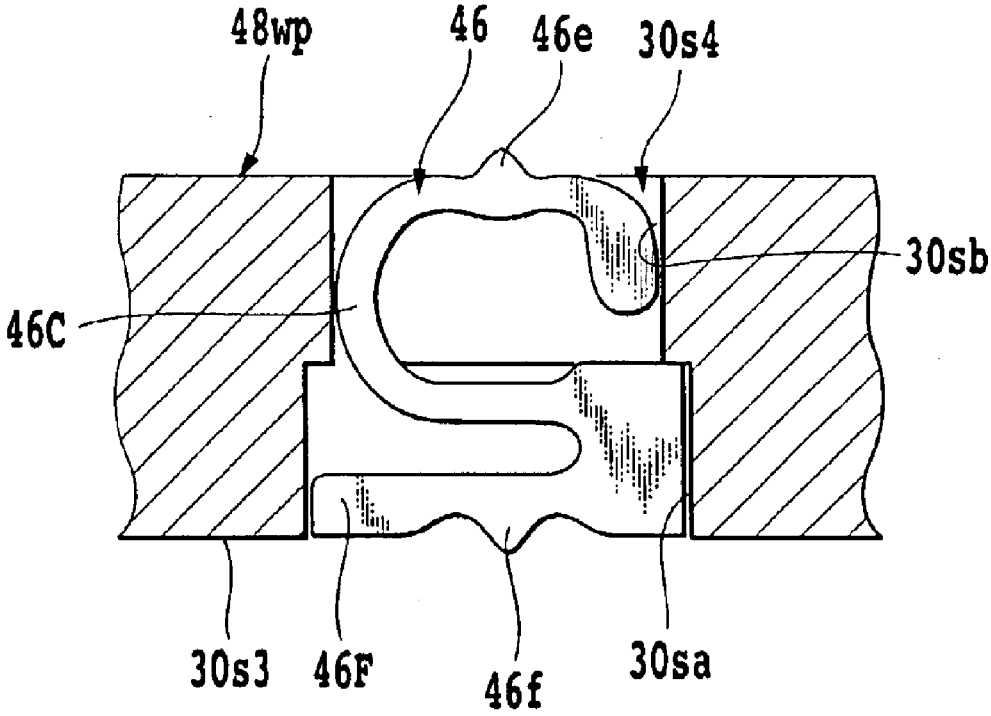
FIG. 6 is a partially sectional view of a movable side terminal in the embodiment shown in FIG. 1.

In a region of the connector body 30 between the slit 30*s*3 and the cable accommodation portion 48, a slit 30*s*4 is formed while intersecting the slit 30*s*3. As shown in FIG. 6 in an enlarged manner, a shape of the slit 30*s*4 consists of two cross-sections having different diameters, that is, a smaller diameter portion 30*sb* and a larger diameter portion 30*sa*. An end of the smaller diameter portion 30*sb* opens on the surface of the positioning portion 48*wp*, and the other end thereof opens in the larger diameter portion 30*sa*. An end of the larger diameter portion 30*sa* opens to the slit 30*s*3. In the interior of the slit 30*s*4, the movable ground terminal 46 is provided.

The movable ground terminal 46 is made, for example, of phosphor bronze or beryllium copper and includes a C-shaped movable portion 46C having a movable contact portion 46*e* to be electrically connected to the ground electrode of the terminal section 32E, and a fixed portion 46F coupled to one end of the movable portion 46C and having a contact portion 46*f* electrically connected to the connection terminal section 36B, as shown in FIG. 6. The fixed portion 46F is inserted into the larger diameter portion 30*sa*, and the movable portion 46C is inserted into the smaller diameter portion 30*sb*. Accordingly, the joint between the fixed portion 46F and the movable portion 46C is inhibited from moving toward the smaller diameter portion 30*sb* by the engagement thereof with a step height between the smaller diameter portion 30*sb* and the larger diameter portion 30*sa*.

As shown in FIG. 6, the movable contact portion 46*e* of the movable portion 46C enters the cable accommodation portion 48 when the terminal section 32E of the flexible printed circuit 32 is not inserted through the slit 30*s*4, as shown in FIG. 6, and on the other hand, is pressed by the terminal section 32E into the slit 30*s*4 against the elastic force of the movable portion 46C thereof when the terminal section 32E of the flexible printed circuit 32 is inserted.

When assembled, the movable ground terminal 46 is inserted into the slit 30*s*4 through the slit 30*s*5 communicated to the slit 30*s*4 before the fixed ground terminal 36*ai* has been inserted.

Figure 7:
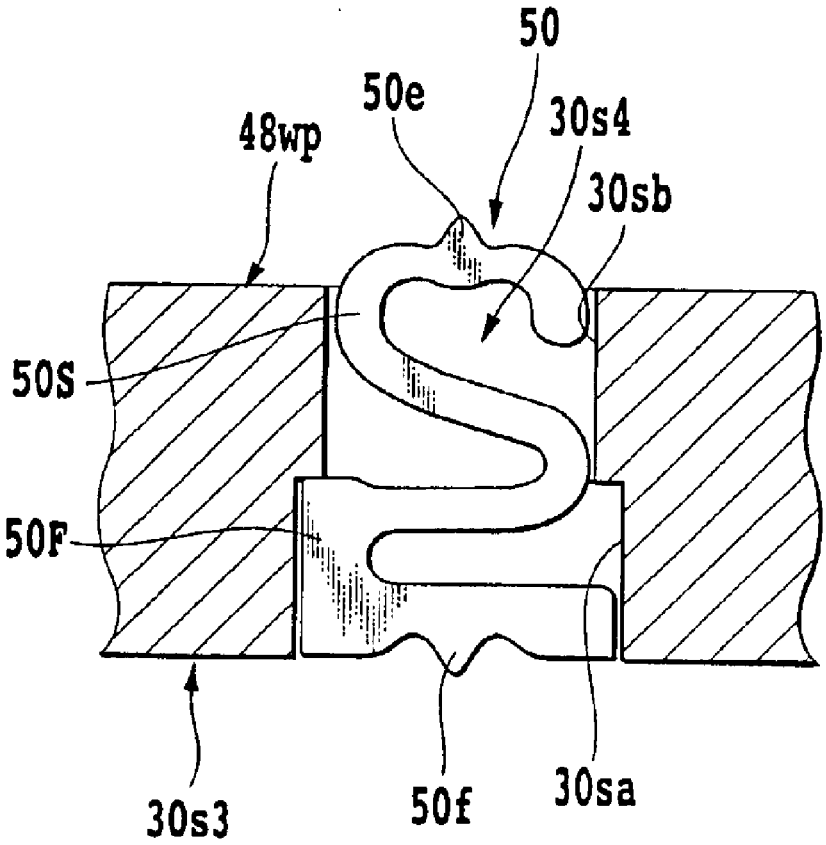
FIG. 7 is a partially sectional view of a movable side terminal in another embodiment.

In this regard, a shape of the movable ground terminal 46 should not be limited to that of this embodiment, but may be a shape of a movable ground terminal 50 shown in FIG. 7 in an enlarged manner, which is made, for example, of phosphor bronze or beryllium copper and includes an S-shaped movable portion 50S having a movable contact portion 50*e* to be electrically connected to the ground electrode of the terminal section 32E, and a fixed portion 50F coupled to one end of the movable portion 50S and having a contact portion 50*f* electrically connected to the connection terminal section 36B. The fixed portion 50F is inserted into the larger diameter portion 30*sa*, and the movable portion 50S is inserted into the smaller diameter portion 30*sb*.

The movable contact portion 50*e* of the movable portion 50S enters the interior of the cable accommodation portion 48 through the slit 30*s*4 as shown in FIG. 7 when the terminal section 32E of the flexible printed circuit 32, and on the other hand, is pressed into the slit 30*s*4 by the terminal section 32E against the elastic force of the movable portion 50S thereof when the terminal section 32E of the flexible printed circuit 32 is inserted.

Figure 5:
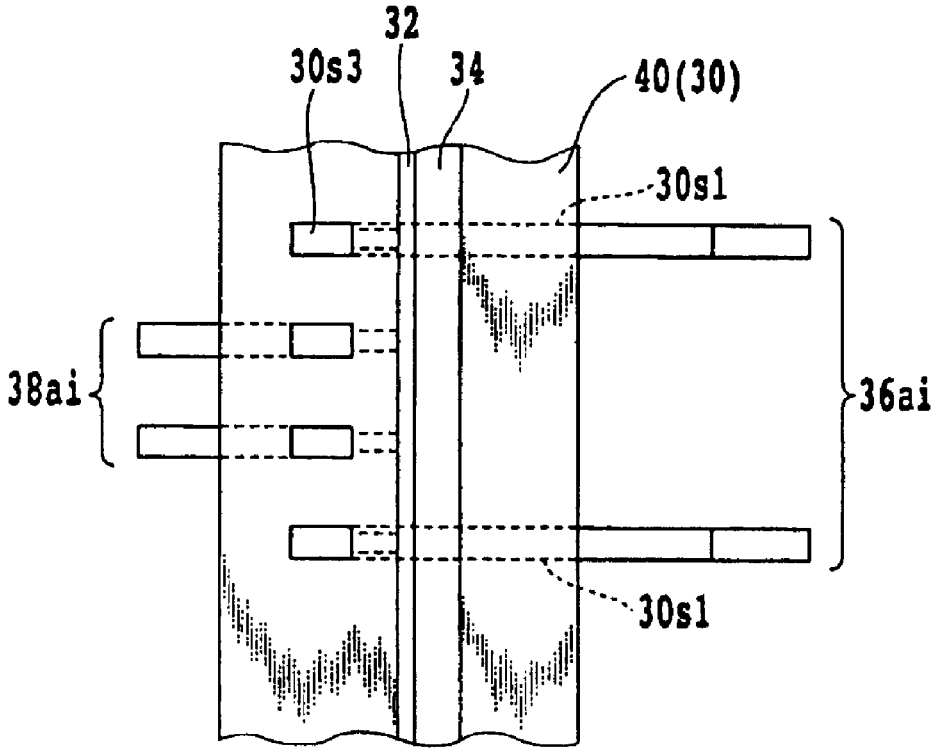
FIG. 5 is a plan view illustrating part of the embodiment shown in FIG. 4.

As shown in FIG. 5, two slits 30*s*9 into which are respectively inserted the fixed signal terminals 38*ai* are provided at a predetermined gap between the adjacent slits 30*s*3 in the connector body 30. The respective slits 30*s*9 are formed parallel and opposite to each other. The slit 30*s*9 is coupled to a slit 30*s*8 formed at the end of the connector body 30 closer to the side of the printed wiring board 42. The arrangement of the slits 30*s*9 are formed on the same line as the arrangement of the slits 30*s*3.

As shown in FIG. 1, the fixed signal terminal 38*ai* as a second contact terminal includes a connection terminal 38B inserted into the slit 30*s*9 and a fixed terminal section 38S coupled to the connection terminal 38B and soldered to the terminal section of the printed wiring board 42. The fixed terminal section 38S is inserted into the slit 30*s*8.

A slit 30*s*6 is formed in a region of the connector body 30 between the slit 30*s*9 and the cable accommodation portion 48 while intersecting the slit 30*s*9. Similar to the embodiment shown in FIG. 6 in an enlarged manner, a shape of the slit 30*s*6 consists of two cross-sectional portions having different diameters, that is, a smaller diameter portion and a larger diameter portion. An end of the smaller diameter portion 30*sb* opens on the surface of the positioning portion 48*wp*, and the other end thereof opens in the larger diameter portion. An end of the larger diameter portion opens to the slit 30*s*9. In the interior of the slit 30*s*6, the movable signal terminal 44 is provided.

The movable signal terminal 44 is made, for example, of phosphor bronze or beryllium copper and includes a C-shaped movable portion 44C having a movable contact portion 44*e* to be electrically connected to the ground electrode of the terminal section 32E, and a fixed portion 44F coupled to one end of the movable portion 44C and having a contact portion 44*f* electrically connected to the connection terminal section 38B, as shown in FIG. 1. The fixed portion 44F is inserted into the larger diameter portion of slit 30*s*6, and the movable portion 44C is inserted into the smaller diameter portion thereof. Accordingly, the joint between the fixed portion 44F and the movable portion 44C is inhibited from moving toward the smaller diameter portion by the engagement thereof with a step height between the smaller diameter portion and the larger diameter portion.

The movable contact portion 44*e* of the movable portion 44C enters the cable accommodation portion 48 through the slit 30*s*6 when the terminal section 32E of the flexible printed circuit 32 is not inserted, and on the other hand, is pressed by the terminal section 32E into the slit 30*s*6 against the elastic force of the movable portion 44C thereof when the terminal section 32E of the flexible printed circuit 32 is inserted.

When assembled, the movable signal terminal 44 is inserted into the slit 30*s*6 through the slit 30*s*7 communicated to the slit 30*s*6 before the fixed signal terminal 38*ai* has been inserted.

In this regard, a shape of the movable signal terminal 44 should not be limited to that of this embodiment, but may be a shape of an S-shape as shown, for example, in FIG. 7 in an enlarged manner.

According to such a construction, as shown by a chain double-dashed line in FIG. 1, when the pressing piece 40*p* of the stopper member 40 is away from the cable accommodation portion 48 and the pressing piece 36A; i.e., when it is in the unlocked state; the pressing piece 40*p* is away from the pressing piece 36A to be in the non-engaged state. Accordingly, the terminal section 32E of the flexible printed circuit 32 can be inserted into the cable accommodation portion 48 through the inserting opening 51.

When the terminal section 32E of the flexible printed circuit 32 is electrically connected to the fixed ground terminal 36*ai* and the fixed signal terminal 38*ai*, the pressing piece 40*p* of the stopper member 40 is made to slide into the cable accommodation portion 48 after the terminal section 32E of the flexible printed circuit 32 has been inserted into a position in the vicinity of the portion 48*wb* in the cable accommodation portion 48 through the inserting opening 51, as shown by a solid line in FIG. 1.

Thus, the terminal section 32E and the back plate 34 of the flexible printed circuit 32 are pressed onto the movable contact portions 46*e* and 44*e* of the movable signal terminal 44 and the movable ground terminal 46 by the pressing surface 40*ps* of the stopper member 40 to result in the electric connection.

Accordingly, the terminal section 32E is nipped between the pressing surface 40*ps* of the stopper member 40 and the elastically deformed movable portions 44C and 46C and maintained in this state by the mutual frictional force.

Figure 16A:
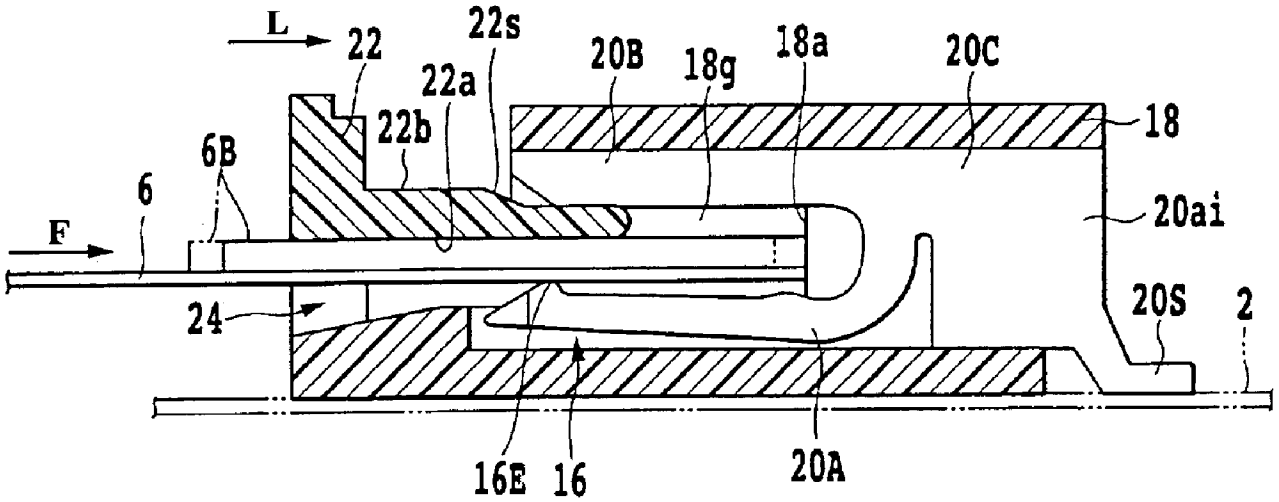
FIG.16A PRIOR ART
FIGS. 16A and 16B are partially sectional views, respectively, illustrating a structure of the conventional cable connector.
Figure 16B:
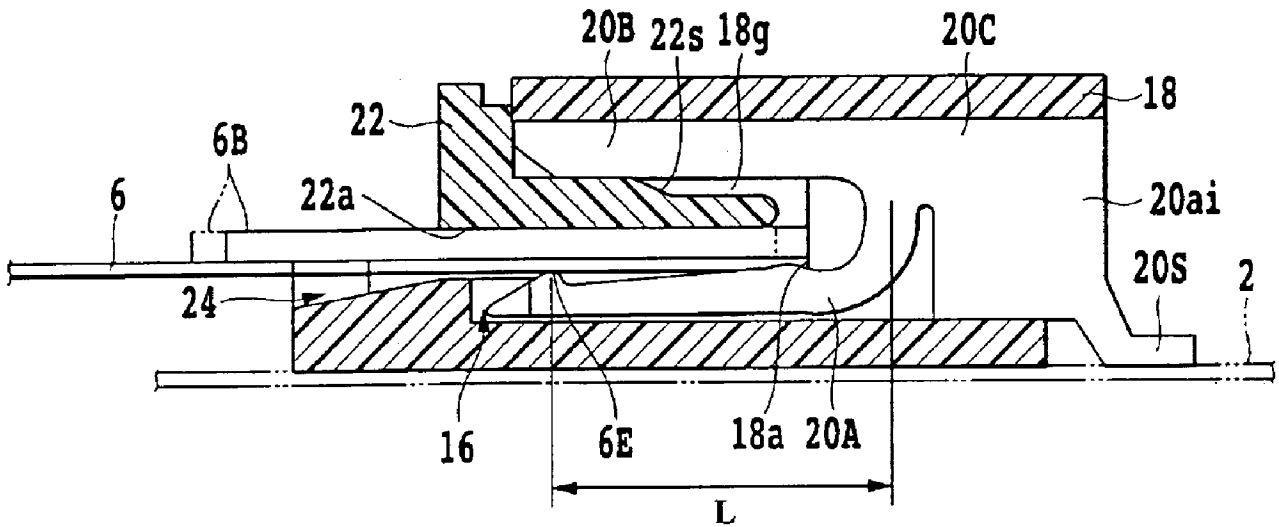
FIG.16B PRIOR ART
Figure 17:
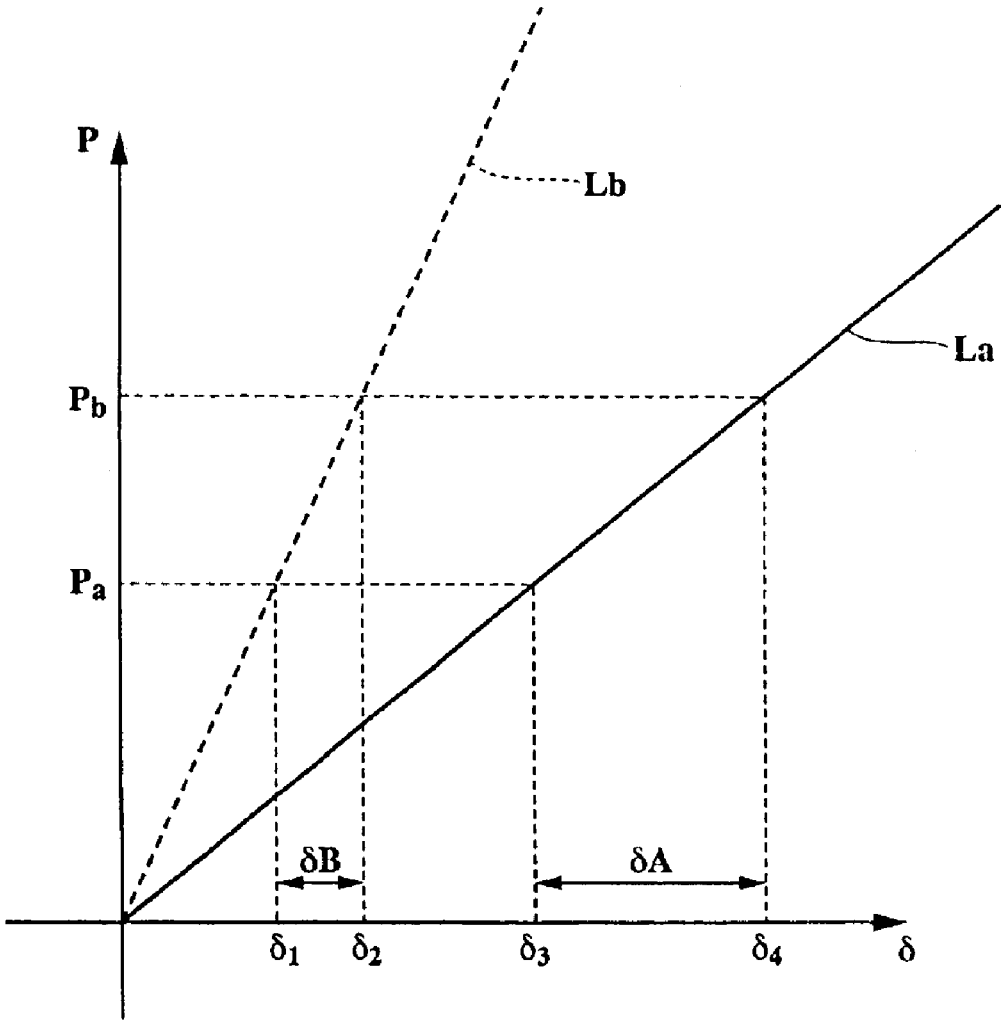
FIG.17 PRIOR ART
FIG. 17 is a characteristic diagram for explaining the structure of the conventional cable connector.

At this time, since the terminal section 32E of the flexible printed circuit 32 is pressed and positioned onto the positioning portion 48*wp* by the stopper member 40, the relative position thereof is not influenced by the variance of the manufacturing accuracy of the stopper member 40, whereby the elastic deformation of the movable portions 44C and 46C is within a predetermined range. Thus, while the contact pressure of the movable contact portion is set at a suitable value, the length L of the fixed signal terminal 38*ai* in FIG. 1 can be shorter than that of the conventional one shown in FIGS. 16A and 16B. As a result, the signal transmission performance in a relatively high frequency band is enhanced due to the reduction of the inductance.

Figure 8:
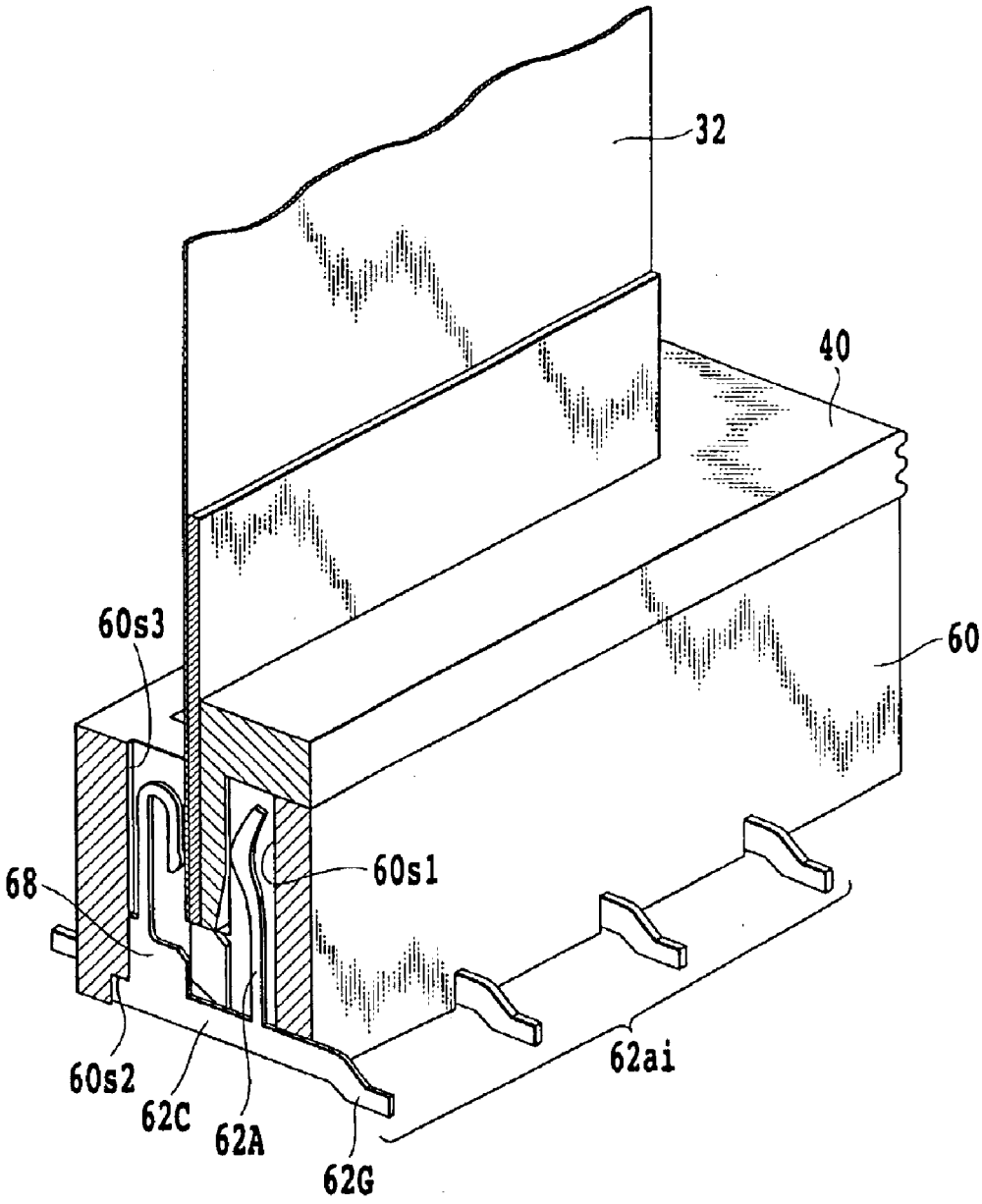
FIG. 8 is a partially cutway perspective view illustrating the appearance of the inventive flat cable connector according to a second embodiment.
Figure 9:
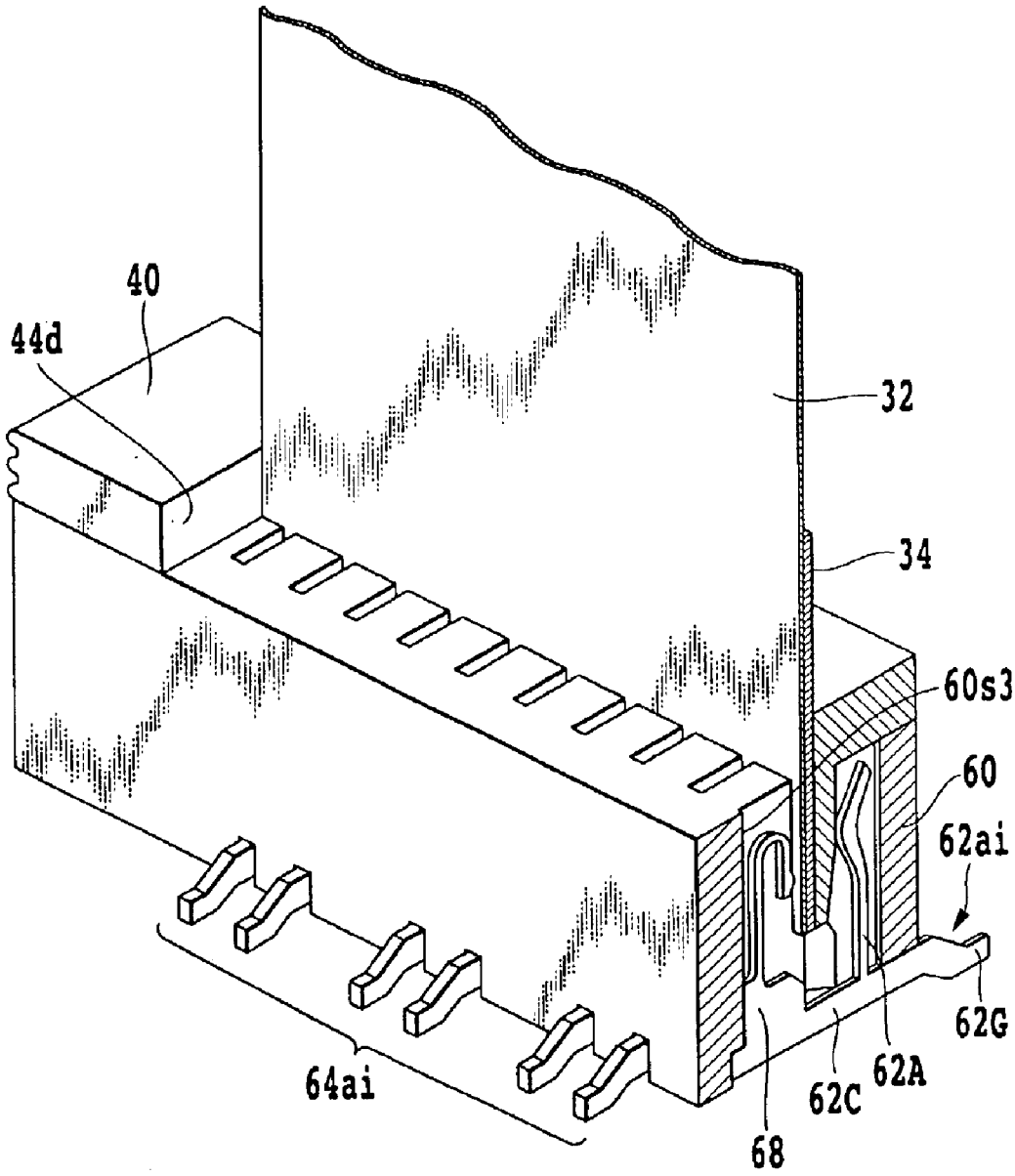
FIG. 9 is a partially cutway perspective view illustrating the appearance of the inventive flat cable connector according to the second embodiment.

FIGS. 8 and 9 illustrate the appearance of a flat cable connector according to a second embodiment of the present invention.

In this regard, in FIGS. 8 and 9, the same reference numerals are used for denoting the same elements and the explanation thereof will be eliminated.

The cable connector includes a connector body 60 disposed, for example, on a printed wiring board 42 and having a cable accommodation portion 70, a plurality of fixed signal terminals 64*ai* (wherein i=1 to n; n is a positive integer) for electrically connecting an electrode section of the printed wiring board 42 to a signal line in a terminal section 32E of a flexible printed circuit 32, and a plurality of fixed ground terminals 62*ai* (wherein i=1 to n; n is a positive integer) for electrically connecting the electrode section of the printed wiring board 42 to a ground line in a terminal section 32E of a flexible printed circuit 32, and a stopper member 40 supported to be slidable relative to the connector body 60.

The connector body 60 has an inserting opening 72 at one end thereof for allowing the terminal section 32E of the flexible printed circuit 32 to be connected and the back plate 34 to pass through the same. The inserting opening 72 is communicated with the cable accommodation portion 70 formed in the interior of the connector body 60. The cable accommodation portion 70 in the connector body 60 is defined by the inner wall of the connector body 60 encircling the same. The inner wall consists of a portion 70*wa* formed in correspondence to the outer surface contiguous to the slant of the pressing piece 40*p* in the inserted stopper member 40, a portion 70*wb* abutting to a tip end of the pressing piece 40*p* of the stopper member 40 when the terminal section 32E of the flexible printed circuit 32 is connected, the positioning portion 70*wp* for positioning the terminal section 32E, and opposite lateral surfaces extending generally vertical to the paper of FIG. 10.

Figure 10:
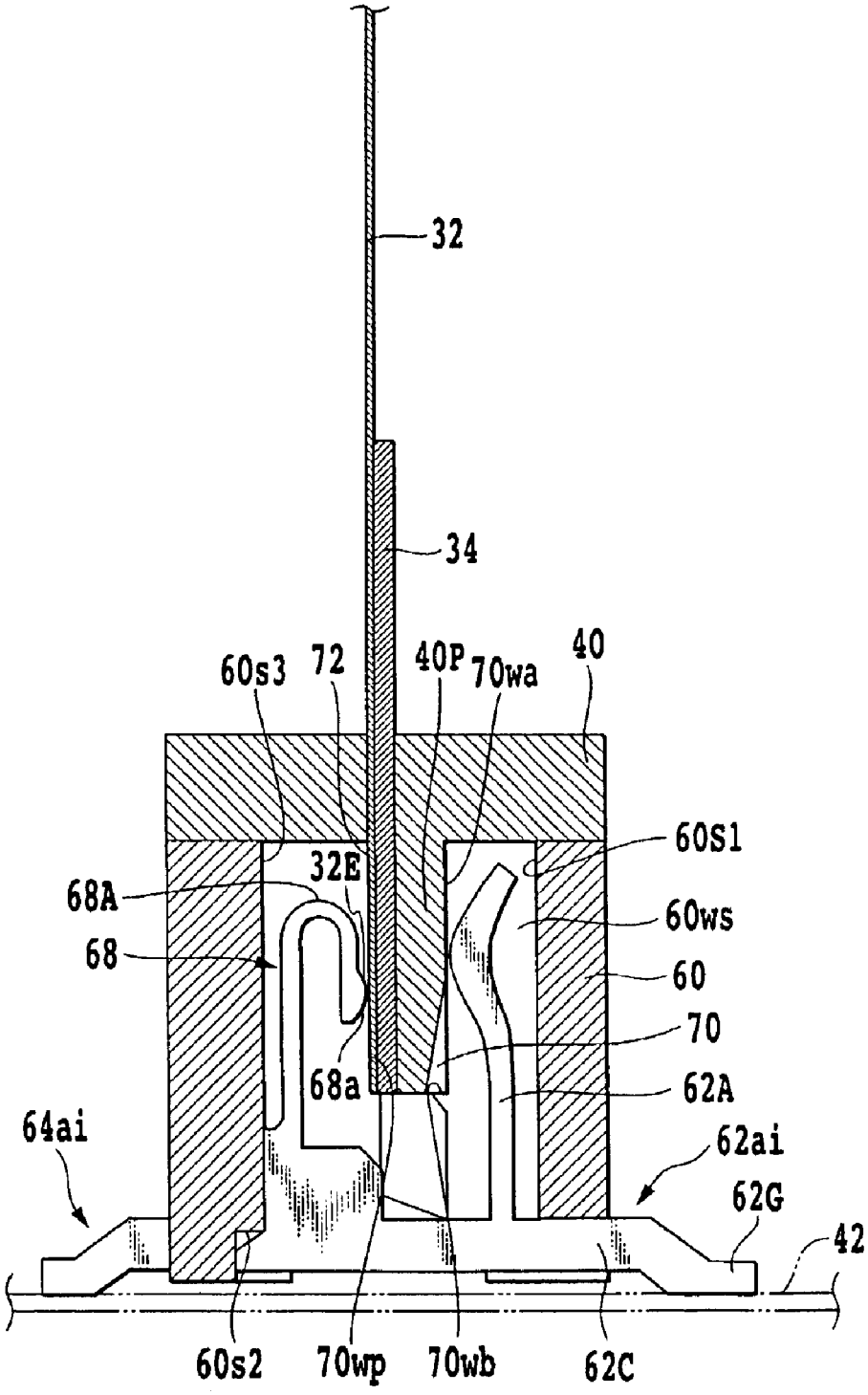
FIG. 10 is a partially sectional view of a substantial part of the flat cable connector according to the embodiment shown in FIG. 8.

On one side adjacent to the cable accommodation portion 70, a plurality of slits 60*s*1 are formed as shown in FIGS. 8 and 10, into which are inserted pressing pieces 62A of the fixed ground terminals 62*ai*. The respective slits 60*s*1 are communicated with the cable accommodation portion 70. The adjacent slits 60*s*1 are sectioned by a partition wall 60*ws*. On the other side adjacent to the cable accommodation portion 70, a slit 60*s*3 into which is press-fit the movable terminal 68 of the respective fixed ground terminal 62*ai* is formed opposite to the slit 60*s*1 in a plane common thereto. The slits 60*s*1 adjacent to each other are sectioned by a partition wall. The slits 60*s*1 and 60*s*3 are connected with each other via a slit 60*s*2 formed at an end the connector body 30 to be fixed to the printed wiring board 42. The slits 60*s*1 and 60*s*3 are formed generally parallel to each other and generally vertical to the connection surface of the printed wiring board 42 while intervening the cable accommodation portion 70 between the both. Also, the slit 60*s*2 into which is inserted a coupling section 62C described later is formed generally parallel to the connection surface of the printed wiring board 42.

Figure 11:
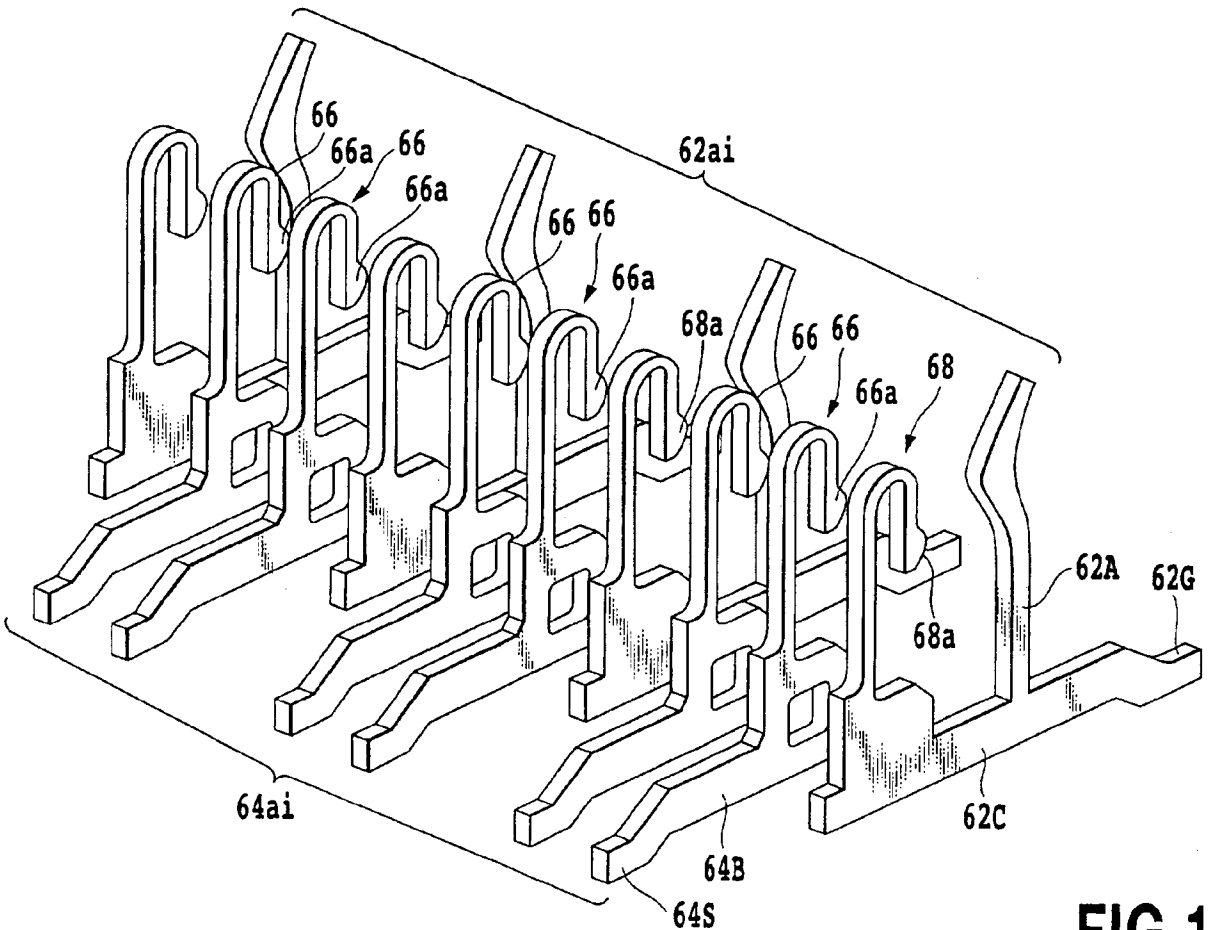
FIG. 11 is a perspective view illustrating the arrangement of a group of terminals in the embodiment shown in FIG. 8.
Figure 12:
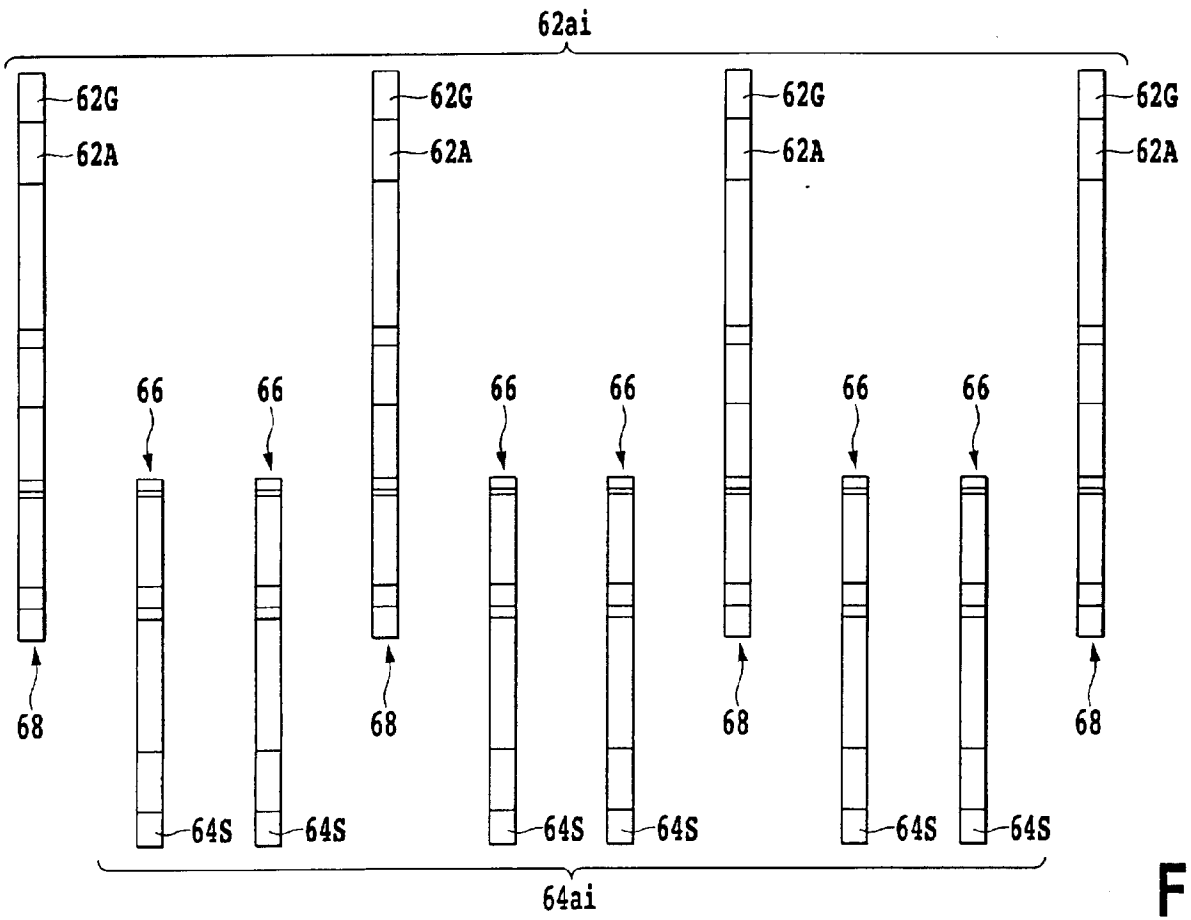
FIG. 12 is a plan view of the embodiment shown in FIG. 11.

As shown in FIGS. 10 and 11, the plurality of fixed ground terminals 62*ai* are made of thin metallic sheet, for example, of phosphor bronze or beryllium copper, and arranged in the cable accommodation portion 70 in correspondence to the ground electrodes of the terminal section 32E in the flexible printed circuit 32. The respective fixed ground terminal 62*ai* includes a fixed terminal section 62G soldered to the terminal section of the printed wiring board 42, the movable terminal section 68 and the pressing piece 62A formed generally parallel to each other in a bifurcate manner, and the coupling section 62C for coupling the fixed terminal section 62G with the proximal end of the movable terminal section 68 and the pressing piece 62A.

A curved portion of the pressing piece 62A in the respective fixed ground terminal 62*ai* is disposed opposite to the pressing piece 40*p* of the inserted stopper member 40. When the pressing piece 40*p* of the stopper member 40 is not inserted, the curved portion of the pressing piece 62A enters the cable accommodation portion 70. On the other hand, when the pressing piece 40*p* of the stopper member 40 is inserted, the curved portion of the pressing piece 62A is pushed away from the cable accommodation portion 70 by the pressing piece 40*p*. Thus, the pressing piece 62A pushes, as biasing means, the pressing piece 40*p* of the inserted stopper member 40 toward the positioning portion 70*wp* in the cable accommodation portion 70 at a predetermined pressure.

The movable terminal 68 disposed in the slit 60*s*3 is provided with a curved portion 68A having a movable contact portion 68*a*. The curved portion 68A extends generally parallel to the pressing piece 62A and then is curved in a U-shape toward the terminal section 32E. The movable contact portion 68*a* partially enters the cable accommodation portion 70 from the slit 60*s*3 when the pressing piece 40*p* of the stopper member 40 is not inserted. On the other hand, the movable contact portion 68*a* is pushed into the slit 60*s*3 when the pressing piece 40*p* of the stopper member 40 is inserted.

Figure 13:
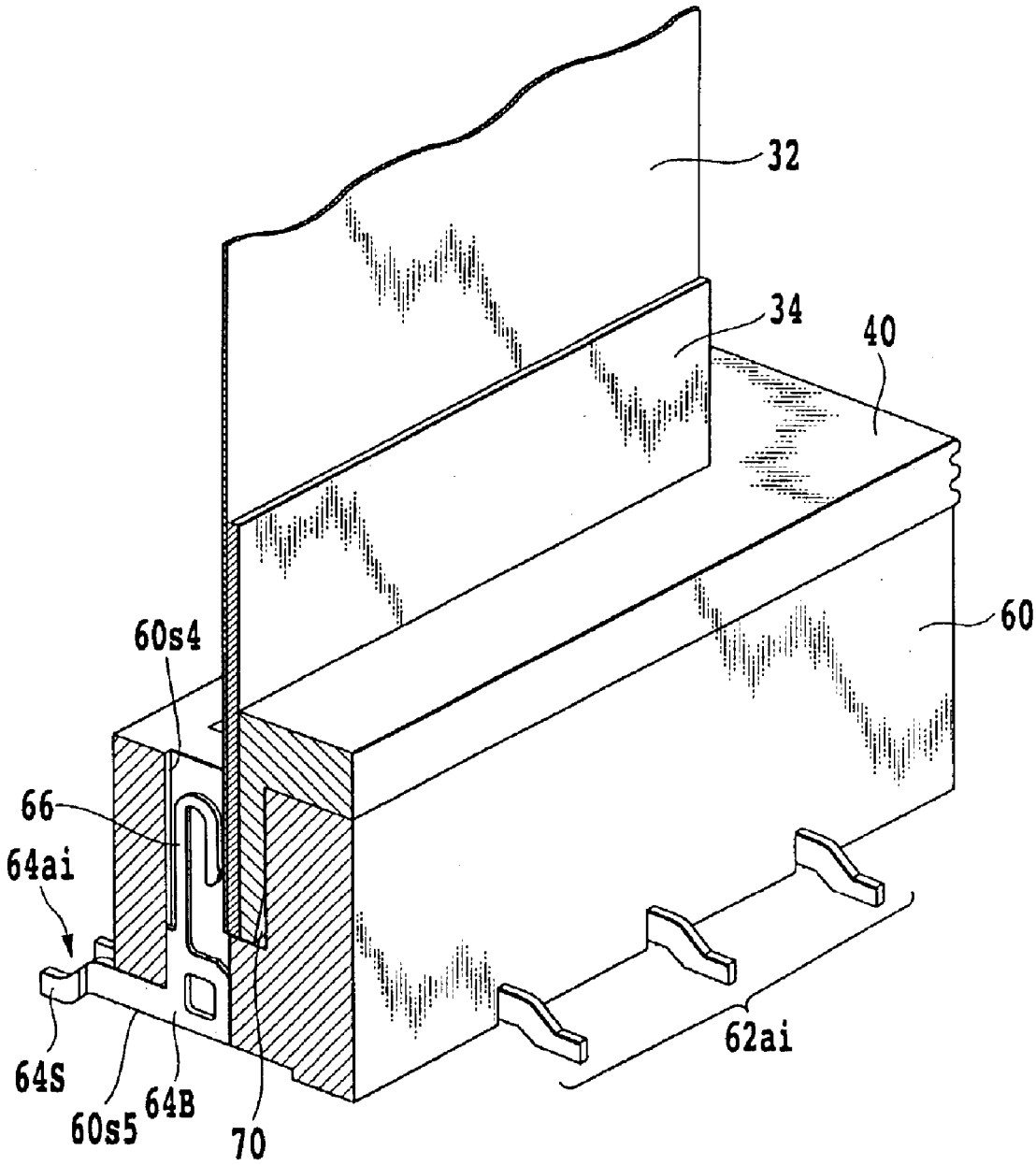
FIG. 13 is a partially cutway perspective view illustrating the appearance of the inventive flat cable connector according to the second embodiment.
Figure 14:
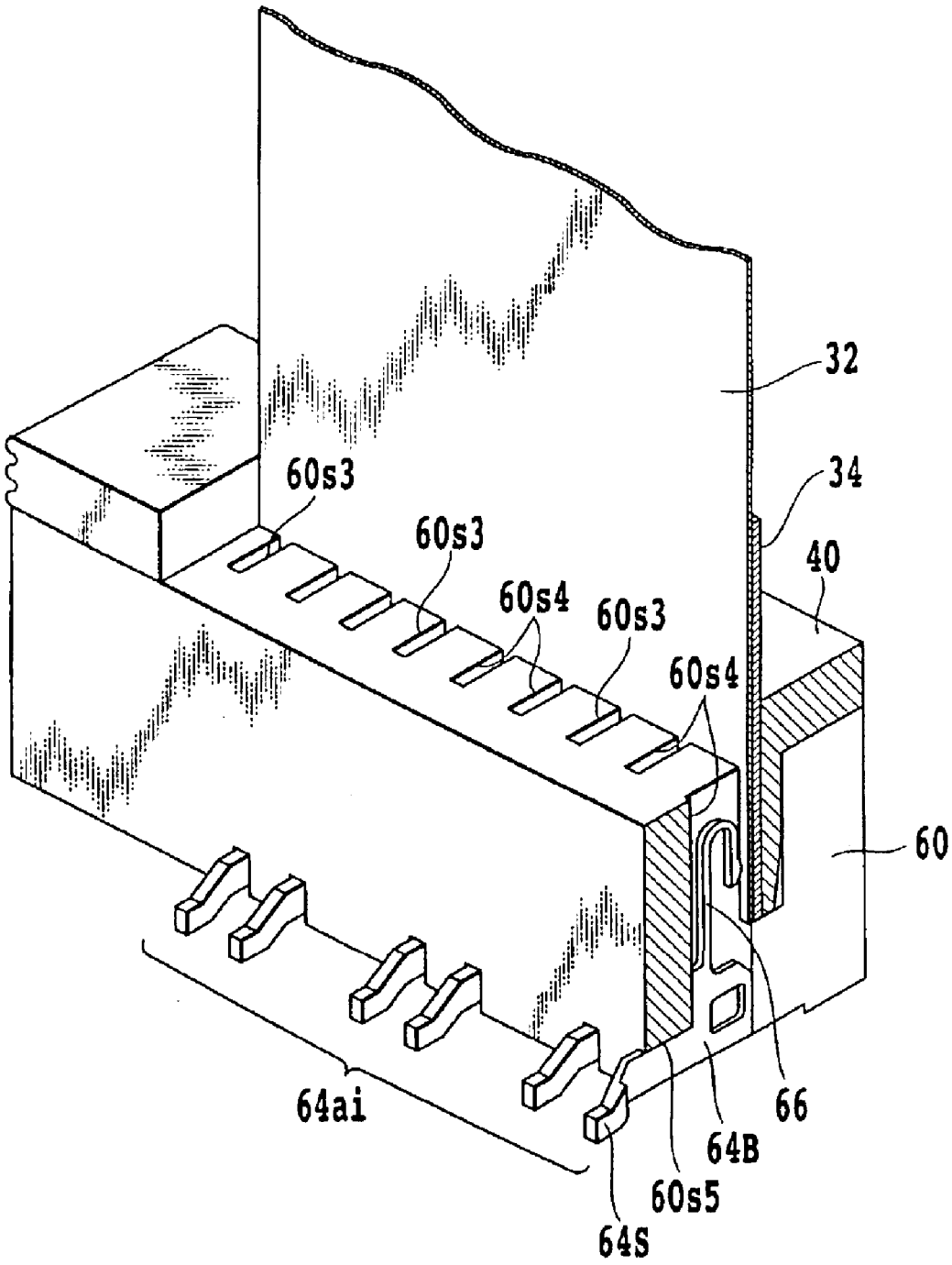
FIG. 14 is a partially cutway perspective view illustrating the appearance of the inventive flat cable connector according to the second embodiment.

As shown in FIGS. 13 and 14, two slits 60*s*4 into which are inserted the fixed signal terminals 64*ai*, respectively, are formed at a predetermined distance between every adjacent slits 60*s*3 in the connector body 60 on the same line as the arrangement of the slits 60*s*3. The respective slits 60*s*4 are formed parallel and opposite to each other. The slit 60*s*4 is coupled to a slit 60*s*5 formed at an end of the connector body 60 closer to the printed wiring board 42.

The fixed signal terminal 64*ai* used as a second contact terminal is made, for example, of phosphor bronze or beryllium copper as shown in FIGS. 11 and 13, and includes a movable terminal section 55 to be inserted into the slit 30*s*4, a coupling section 64B coupled to the proximal end of the movable terminal section 66, and a fixed terminal section 64S coupled to the coupling section 64B and soldered to the terminal section of the printed wiring board 42. The fixed terminal section 64S is inserted into the slit 60*s*5. The movable terminal section 66 has a movable contact portion 66*a* to be electrically connected with the terminal section 32E.

The movable contact portion 66*a* enters the cable accommodation portion 70 through the slit 60*s*4 when the terminal section 32E of the flexible printed circuit 32 is not inserted, and on the other hand, is pushed into the slit 60*s*4 by the terminal section 32E against the elastic force of the curved portion thereof.

By such a structure, when the pressing piece 40*p* of the stopper member 40 is away from the cable accommodation portion 70 and the pressing piece 62A, that is, when it is in an unlocked state, the pressing piece 40*p* is away from the pressing piece 62A to be in a non-engaged state. Therefore, the terminal section 32E of the flexible printed circuit 32 can be inserted into the cable accommodation portion 70 via the inserting opening 72.

When the terminal section 32E of the flexible printed circuit 32 is electrically connected to the fixed ground terminal 62*ai* and the fixed signal terminal 64*ai*, the pressing piece 40*p* of the stopper member 40 is slid into the cable accommodation portion 70 after the terminal section 32E of the flexible printed circuit 32 has been inserted to a position in the vicinity of the portion 70*wb* of the cable accommodation portion 70.

Accordingly, the terminal section 32E and the back plate 34 of the flexible printed circuit 32 are pressed onto the movable contact portions 68*a* and 66*a* of the movable terminal sections 68 and 66, respectively, and electrically connected thereto.

Thus, the terminal section 32E is nipped between the pressing surface 40*ps* of the stopper member 40 and the movable contact portions 68*a* and 66*a* of the movable terminal sections 68 and 66, respectively, and maintained there by the mutual frictional force.

Figure 15:
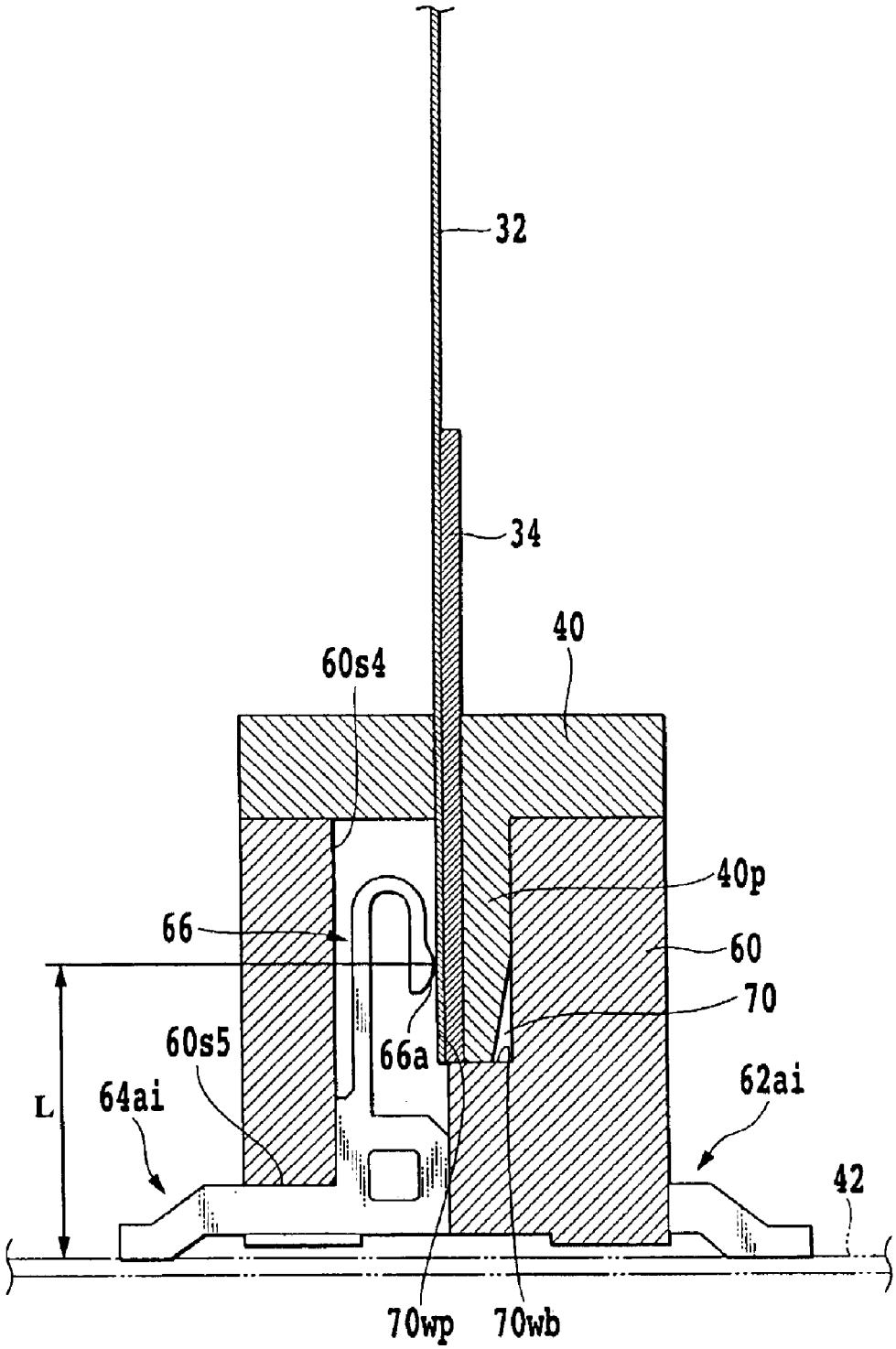
FIG. 15 is a partially sectional view of a substantial part of the flat cable connector according to the embodiment shown in FIG. 13.

At that time, since the terminal section 32E of the flexible printed circuit 32 is positioned by being pressed onto the positioning portion 70*wp* by the stopper member 40, the elastic displacement of the movable contact portions 66*a* and 68*a* of the movable terminal section 66 and 68 is within a predetermined range, irrespective of the variance of the manufacturing accuracy of the stopper member 40. Accordingly, while maintaining a contact pressure of the movable contact portion at a proper value, the length L of the movable terminal section 66 in the fixed signal terminal 64*ai* in FIG. 15 can be shorter than that of the conventional one shown in FIGS. 16A and 16B. As a result, the inductance is reduced to enhance the signal transmission performance in a relatively high frequency band.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A connector for a flat cable comprising:

a connector body having an accommodation portion for accommodating a coupling section of a flat cable, a first contact terminal including a first terminal-forming section disposed adjacent to said accommodation portion, having a movable contact portion for electrically connecting with an electrode section of said coupling section, and a bias portion for biasing said electrode section of said flat cable toward said movable contact portion of said first-terminal-forming section;

a second contact terminal including a second terminal-forming section disposed together with said first contact terminal adjacent to said accommodation portion, said second terminal-forming section having a second movable contact portion for electrically connecting with said electrode section of said coupling section in said flat cable; and a positioning section formed in said accommodation portion for locating said electrode section of said coupling section relative to said first and second movable contact portions in said first and second contact terminals in the displacement direction of said movable contact portions.

2. A connector for a flat cable as claimed in claim 1, wherein said first terminal-forming section of said first contact terminal, comprises:

a connection terminal section; and a movable terminal holding said first movable contact portion and electrically connected to said connection terminal section.

3. A connector for a flat cable as claimed in claim 2, wherein said connection terminal section and said bias portion in said first contact terminal are formed in one piece.

4. A connector for a flat cable as claimed in claim 2, wherein said movable terminal and said connection terminal section are formed in one piece.

5. A connector for a flat cable as claimed in claim 1, wherein said electrode section of said flat cable is positioned by said positioning section at a position between said movable contact portion of said first terminal-forming section and said bias portion in said first contact terminal.

6. A connector for a flat cable as claimed in claim 1, wherein said first contact terminal is a ground contact terminal for the grounding, and said second contact terminal is a signal terminal for the signal transmission.

7. A connector for a flat cable as claimed in claim 1, wherein when said coupling section of said flat cable is accommodated is said accommodation portion, said bias portion biases said electrode section of said coupling section toward said positioning section via a stopper member disposed between said coupling section and said bias portion in said first contact terminal.

8. A connector for a flat cable as claimed in claim 1, wherein said first terminal-forming section and said bias portion in said first contact terminal and said second terminal-forming section in said second contact terminal are elastically deformable.

9. A connector for a flat cable as claimed in claim 1, wherein said second terminal-forming section of said second contact terminal comprises:

a connection terminal section; and a movable terminal holding said second movable contact portion and electrically connected to said second connection terminal section.

10. A connector for a flat cable as claimed in claim 9, wherein said movable terminal and said connection terminal section are formed in one piece.

11. A connector for a flat cable as claimed in claim 1, wherein said bias portion biases said electrode section of said flat cable toward said movable contact portion of said first terminal-forming section at a predetermined pressure.

* * * * *

UNITED STATES PATENT AND TRADEMARK OFFICE

CERTIFICATE OF CORRECTION

PATENT NO. : 6,869,307 B2
DATED : March 22, 2005
INVENTOR(S) : Toshio Endo

It is certified that error appears in the above-identified patent and that said Letters Patent is hereby corrected as shown below:

Column 11,
Line 65, “first-terminal-forming” should read -- first terminal-forming --.

Column 12,
Line 17, “terminal, comprises:” should read -- terminal comprises: --.

Signed and Sealed this

Twenty-third Day of August, 2005

JON W. DUDAS
*Director of the United States Patent and Trademark Office*